US006012436A

United States Patent [19]

Boutcher

[11] Patent Number: 6,012,436

[45] Date of Patent: Jan. 11, 2000

[54] BOLT-ON SUPER CHARGER SYSTEM AND METHOD

[76] Inventor: Peter Boutcher, 24 Fern Rd., North Hampton, N.H. 03862

[21] Appl. No.: 09/120,782

[22] Filed: Jul. 22, 1998

[51] Int. Cl.[7] ..... F02B 33/00

[52] U.S. Cl. ..... 123/559.1

[58] Field of Search ..... 123/559.1, 564

[56] References Cited

U.S. PATENT DOCUMENTS 5,460,145 10/1995 Perry, Jr. ..... 123/559.1

*Primary Examiner*—Noah P. Kamen

*Attorney, Agent, or Firm*—Paul C. Remus, Esquire; Kristin Kohler, Esquire; Devine, Millimet & Branch, Professional Association

[57] ABSTRACT

A system and method for supercharging an in-line engine is disclosed. The system comprises a "bolt-on" supercharger system that is attachable directly to an existing installed engine without significant modification of the engine. The system includes an intake manifold fabricated preferably from aluminum and appropriately sized to the particular engine and available space, and which is removably attachable to the stock intake manifold of an engine in flow communication with the stock intake manifold; a supercharger removably attachable to, and in flow communication with, the fabricated intake manifold, by use of an adapter plate; a bypass valve assembly attached between and in straight line flow communication with a carburetor or fuel injected system and the supercharger. The bypass valve is joined to the carburetor by a bypass adapter ring, and allows an air-fuel mixture from the carburetor to bypass the supercharger and go directly into the fabricated intake manifold when the system is not in a boost mode. The entire system is attachable with nuts, bolts and rubber, or rubber-like, washers to prevent air leakage when under boost conditions. The system provides boost with no hesitation when the accelerator is depressed and boost is even and steady over the entire RPM range. The system can be additionally air cooled by adding at least one hose connected to the air filter to direct cool air into the air filter. The system can be adapted to carbureted or fuel injected engines, cable or mechanical throttle systems, and does not interfere with any existing emission control devices on the engine.

27 Claims, 3 Drawing Sheets

BOLT-ON SUPER CHARGER SYSTEM AND METHOD

FIELD OF THE INVENTION

The invention relates generally to supercharging internal combustion engines. More particularly, the invention relates to a system and method for supercharging in-line internal combustion engines which system is relatively easy to install. Most particularly the system and method enable supercharging of in-line internal combustion engines with relatively easy installation and without significant modification to the existing engine structure or layout. The present invention is particularly useful with relatively small engines or where there is not a great deal of available extra space around the engine for addition of components or modification of the engine, but may be used on any in-line engine including automobile and boat engines.

BACKGROUND OF THE INVENTION

There are currently many varieties of turbo chargers and superchargers and various ways to turbo or supercharge engines. However, many of these systems and methods require rather extensive modification of the existing engine and often can not be done by relatively modestly experienced mechanics. Another problem with existing systems is that they may not even fit or be usable with certain types of designs and engines, such as, for example, the engines of relatively small sports cars having small engine compartments.

In response to past gasoline crises, engines were made smaller to improve gas mileage. Various other fuel saving modifications have been made to engines to improve gas mileage as well, but result in the engine having decreased power. The turbo-supercharger or turbocharger is a popular option for boosting engine power. However, because turbo chargers are exhaust driven, they tend to raise the temperature in the engine, thereby requiring additional cooling or protective materials, and they also therefore have a characteristic time delay in achieving the boosted power. Mechanically driven superchargers linked directly to the engine eliminate many of the problems associated with turbo chargers. However, there are different problems with superchargers located in the engine compartment, such as, susceptibility to wear, expense of installation, difficulty adapting to various types of engines and also problems of physically locating the components because of limited space in the engine compartment, especially with smaller cars and smaller engines.

Some previously developed systems are discussed below and are illustrative of the state of this particular art. Various problems regarding size, adaptability to different engines, and ease of installation have been addressed in part by some of these systems.

The U.S. Pat. No. 5,263,463 patent to Perry discloses a compact motorcycle supercharging apparatus. The main objective of this invention is to provide a compact motorcycle-installable supercharger that can be placed in several different positions or orientations on the motorcycle, as desired. The invention also provides protective cover plates to protect the rider's legs from the supercharger and its drive mechanism.

The U.S. Pat. No. 5,224,459 patent to Middlebrook is directed to a supercharger for internal combustion engines, specifically a centrifugal supercharger. The supercharger housing is adaptable to be installable with a number of different types of engine. This patent states that the invention is more efficient, reliable, and adaptable to be installed on various engines than previous superchargers. Whenever the engine is in operation, the air in this system passes through the supercharger without being able to be fed directly to the engine.

The U.S. Pat. No. 5,183,023 patent to Hanson discloses an evaporative emission control system for a supercharged internal combustion engine. The emission control system operates as does a conventional emission control system when the engine is not running in a supercharged mode. When the engine is supercharged, the emission control system diverts some high pressure vapors from the combustion chamber to mix with incoming air in the supercharger to reduce unburned material and emissions.

The U.S. Pat. No. 5,140,816 patent to Scicluna discloses an internal combustion engine turbo charger particularly for motorcycles such that it can be readily installed without having to perform any substantial alteration to the standard factory production state of the vehicle. There is a "dump valve" for release of air if the pressure in a conduit which connects an air compressor outlet to the carburetor inlet is too great.

The U.S. Pat. No. 4,401,060 patent to Goodman discloses a fluid injection system for a supercharged internal combustion engine. In this patent, the engine is already supercharged, and the patented invention provides a better way to introduce a cooling fluid, such as water, into the air intake side of a supercharged engine to obtain precise metering of the injected fluid. The injection system of this patent is easy to install on supercharged engines and is suited to aftermarket installation.

Some prior systems also do not provide direct, or "straight line" flow of air-fuel mixture from the carburetor or fuel injection system to the supercharger. These systems require additional piping or hoses and create turbulence in the air-fuel flow, and the flow turbulence reduces efficiency reduces power.

None of the systems discussed above completely solves the problems of providing a relatively easily installable supercharger, for in-line engines, that is directly attachable to the existing engine without significant modification to the engine, and which would be relatively easily adaptable to various types of engines, and which also would not over stress the stock, unmodified engine, for example with too much increase in compression. Thus there is a need to have a "bolt-on" supercharger system which can be attached to an existing engine without significant effort, or modification to the existing engine and which would solve the problems of adaptability and size requirements or restrictions. It would also be desirable to have a supercharger system which would provide a relief valve system for safety if the pressure in the supercharger system were to become excessive. In addition it would be desirable for a supercharger system to direct air and fuel mixture directly into the engine, not through the supercharger system, when the vehicle is not under boost, but to direct the air and fuel mixture through the supercharger system when the engine is under boost.

SUMMARY OF THE INVENTION

Applicant's system and method for supercharging preferably an in-line internal combustion engine, such as an automobile, marine or other engine, solves the problems of expense, installation and adaptation difficulty without significant modification to the existing engine, allows for all original equipment manufacturer (OEM) emissions controls to be left intact, and also provides a safe, reliable supercharger system with safety features such as a pressure relief valve.

The basic invention comprises a "bolt-on" supercharger system, that is attachable directly to an existing in-line engine, without significant modification of the engine. The system may be used on any in-line engine such as 4 or 6 cylinder automobile or boat engines, and may be adapted to carbureted or fuel injected engines, and engines with cable or mechanical throttle mechanisms. The system comprises an intake manifold fabricated preferably from aluminum which may be appropriately sized to the particular engine and available space, and which is removably attachable to the stock intake manifold of an engine in flow communication with the stock intake manifold; a supercharger or "blower" removably attachable to the fabricated intake manifold and in flow communication with the fabricated intake manifold; and a bypass valve assembly attached to, and in straight line flow communication between, a carburetor and the supercharger. The bypass valve is also attachable to the fabricated intake manifold for times when the system is not under boost. The fabricated intake manifold is essentially a supercharger to intake manifold adapter. The bypass valve allows an air-fuel mixture from the carburetor to bypass the supercharger and go directly into the fabricated intake when the system is not in a boost mode. There is a bypass adapter ring which joins the bypass valve to the carburetor. The ring offers at least one inlet for water injection to prevent detonation at increased RPM and boost, and it may be machined to accept either fuel injected or carbureted engine systems. The adapter ring may also be machined to compensate for OEM manifolds, thereby allowing the parallel placement of fuel system and engine block necessary for proper fuel-air flow. The system may also be additionally air cooled by adding at least one hose directing cool air into the air filter of a carburetor. The invention also provides a "sneeze" or pressure relief valve which will release if the pressure in the system becomes excessive, thereby preventing damage to the supercharger system and engine, for example when cold start backfires occur.

Therefore, an aspect of the invention is to provide a supercharger system that is easily installable on an existing engine with minimal modification to the engine, and to the supercharger itself.

A further aspect of the invention is to provide a supercharger system that is installable with nuts, bolts and rubber or rubber-like washers.

A still further aspect of the invention is to provide a supercharger system that provides direct, straight line flow between the carburetor or fuel injection system, the bypass valve and the supercharger such that flow turbulence is minimized.

Another aspect of the invention is to provide a supercharger system that is relatively inexpensive to manufacture, purchase and install, and which may be adjusted in size to accommodate variously sized and shaped original equipment manufacturer intake manifolds.

A further aspect of the invention is to provide a fuel efficient supercharger system.

A still further aspect of the invention is to provide an air-cooled supercharger system.

Another aspect of the invention is to provide a supercharger system with no hesitation in boost when the accelerator is depressed, and having boost consistent throughout the entire RPM range.

Yet another aspect of the invention is to provide a supercharger system which runs on unleaded gasoline of normal octane levels with no appreciable pre-detonation.

A still further aspect of the invention is to provide a supercharger system which may have a vacuum-boost gauge attached to monitor the boost pressure in the system.

Another aspect of the invention is to provide a supercharger system that has an adjustable "sneeze" or pressure relief valve located on the engine facing side of a fabricated aluminum intake manifold wherein the sneeze valve is set to release if the air pressure in the system increases abruptly. The sneeze valve prevents damage to the supercharger and the engine.

Still another aspect of the invention is to provide a supercharger system that includes at least one fluid inlet port to inject water into the air-fuel mixture to prevent detonation at increased RPM and boost.

A yet further aspect of the invention is to provide a supercharger system which allows for all original equipment manufacturer emissions controls to be left intact upon installation of the supercharger system.

Another aspect of the invention is to provide a system which is adaptable to either fuel injected or carbureted in-line engines.

These and other advantages of the present system will become apparent upon examination of the accompanying Figures and detailed description of the invention.

DETAILED DESCRIPTION OF THE INVENTION

Figure 1:
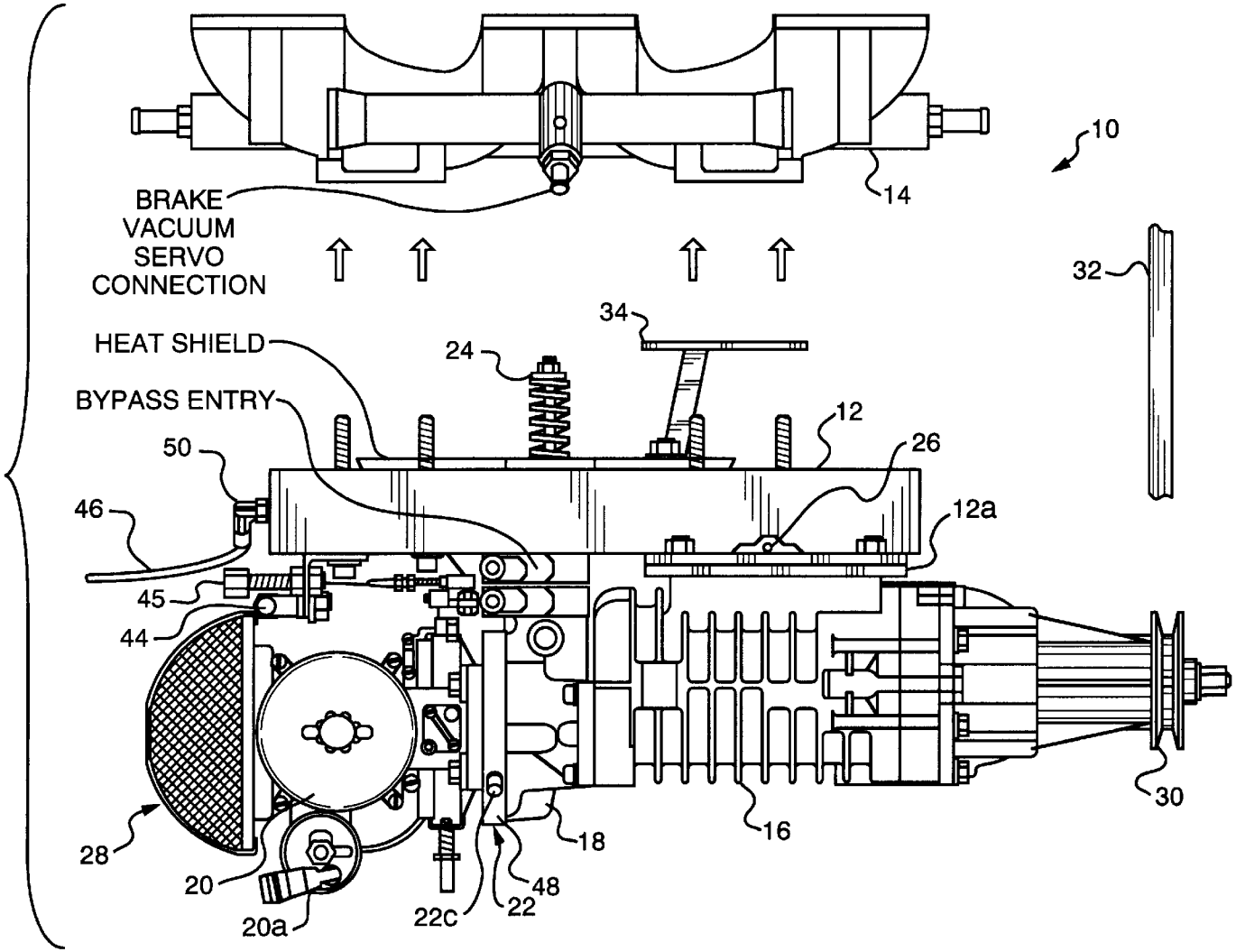
FIG. 1 is an exploded plan view of the invention from above showing the physical layout of the system and its attachment point to the engine's stock intake manifold.
Figure 2:
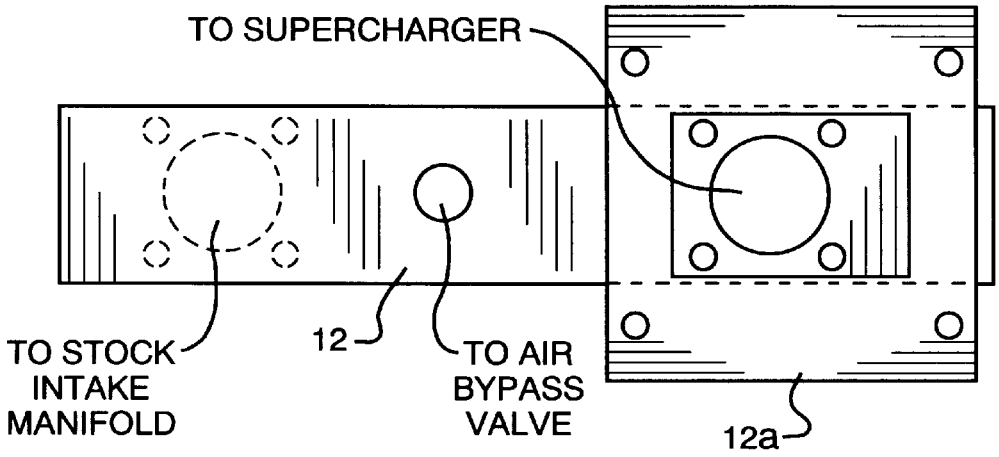
FIG. 2 is a front sectional view of the fabricated intake manifold or supercharger-to-manifold adapter.

Referring now to the figures, in which like reference numerals refer to like elements throughout, FIG. 1 shows the physical orientation of a preferred example embodiment of the system and method of supercharging an internal combustion engine installable in an in-line 6 cylinder car engine. The system provides for direct, unobstructed straight line fuel-air flow from a carburetor or fuel injection system to a supercharger and bypass valve. The invention comprises a "bolt-on" supercharger system 10, that is attachable directly to an existing installed engine without significant modification of the engine, the system comprising an intake manifold 12 fabricated preferably of aluminum and also shown in FIG. 2, to be appropriately sized to the particular engine and available space, and which is removably attachable to the stock intake manifold 14 of an engine and in flow communication with the stock intake manifold 14 and also in flow communication with a supercharger or "blower" 16 which is removably attachable to the fabricated intake manifold 12, and which is in flow communication with the fabricated intake manifold 12; a bypass valve 18 removably attachable, and in straight line flow communication, between a carburetor 20 and the supercharger 16, and in flow communication with fabricated intake manifold 12.

Fabricated intake manifold 12 is attachable to supercharger 16 by an adapter plate 12*a* that aligns the larger pressure outlet opening of supercharger 16 with the smaller inlet opening of fabricated manifold 12. Fabricated intake manifold 12 is also attachable to bypass valve 18.

Figure 3:
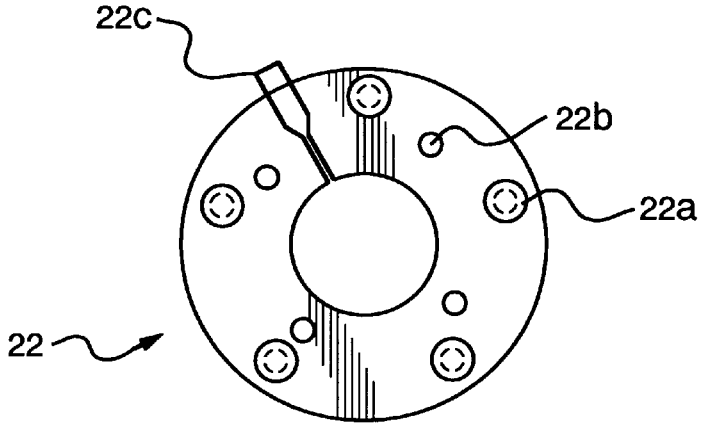
FIG. 3 is a cross sectional view of the bypass ring adapter for connecting the bypass valve to the carburetor.

The bypass valve assembly 18 allows an air-fuel mixture from the carburetor 20 to bypass the supercharger 16 and go directly into the intake manifold 14 of the engine, via fabricated manifold 12, when the system is not in a boost mode. A bypass valve assembly that works in the present system is for example, BP ASSY-62B by Magnuson Products of Ventura, Calif. There is a bypass adapter ring 22 which aids in joining bypass valve 18 to carburetor 20 and which is shown in FIG. 3. The ring 22 offers at least one inlet port 48 for water injection into the engine to prevent pre-detonation at increased RPM and boost, and adapter ring 22 and bypass valve 18 may be machined to accept either fuel injection or carburetors. A fuel injected system would simply inject the fuel-air mixture into bypass valve 18 at the same point where fuel from a carburetor would enter. A fuel injected system would have more horsepower than a carbureted system, however, the Figures in this application show a carbureted system by way of example only. The adapter ring 22 may also be machined to compensate for various sizes and shapes of OEM manifolds thereby allowing the parallel placement of fuel system and engine block that is necessary for proper air-fuel mixture flow. Adapter ring 22 has securing bolt holes 22*a* used to attach adapter ring 22 to bypass valve 18 and additional attachment holes 22*b* used to attach adapter ring 22 to carburetor 20 (or to a fuel injection system). Inlet port 48 extends through adapter ring 20 from its outer surface to the inner fluid passageway 22*d*. Inlet port 48 comprises a threaded opening bored into adapter ring 22 to a length of about ½ the distance from the outer surface of adapter ring 22 to the inner fluid passageway 22*d*. The remaining distance is preferably a smooth-walled bore much smaller in diameter than the threaded bore. A fitting 22*c* is attached in the threaded bore and fluid is injected through the fitting and into the inner fluid passageway 22*d* of adapter ring 22 to mix with the air-fuel mixture. A cooling fluid injection system used to supply the water, or other cooling fluid, is adjustable to begin to inject cooling fluid at a user-determined amount of boost pressure. For example the cooling fluid injection system may be set to begin injecting water at 4 pounds (psi) of boost pressure. Also, the level of acceleration or boost at which bypass valve 18 begins diverting the air-fuel mixture into supercharger 16 is adjustable.

The supercharger 16 is preferably, for example, a helical rotor supercharger such as an Eaton supercharger by Magnuson, for example supercharger model S/C-M62. The carburetor 20 is preferably, for example, an HD 8 SU carburetor by Skinner's Union of the UK. The "float bowl" 20*a* of carburetor 20 that regulates the fuel supply into the carburetor should be as far away from the hot exhaust manifold as possible to prevent heating and potential ignition of the fuel in the bowl. There is also an air filter 28 attached to carburetor 20 to filter the air before it enters carburetor 20. The original carburetors of a particular engine may be used, however the carburetor provided herein as an example is best suited to the high performance requirements of system 10 because it is often more durable and less sensitive and therefore easier to use in and adapt to high performance conditions than the stock carburetor(s) of the vehicle.

The system 10 also includes an adjustable "sneeze" or pressure relief valve 24 located on the side of the fabricated intake manifold 12 facing the engine. Sneeze valve 24 is adjustably set to release if the air pressure in the system increases abruptly. Sneeze valve 24 prevents the possibility of a broken blower blade or a hole in the top of a piston due to excess pressure in the system. An example sneeze valve for use with the present system is the sneeze valve manufactured by MagnaCharger of Orland, Calif. Sneeze valve 24 is preferably located on a wall of fabricated manifold 12 that faces the engine, as shown in FIG. 1.

Pressure outlet side 26 of supercharger 16 is placed preferably almost directly over/across the front three cylinders of the engine, for example in a straight 6 cylinder engine. This location potentially could cause an unequal fuel distribution as is may appear that fuel would reach the first three cylinders before reaching the second three, but this does not happen with the present invention. The airflow of the system, as it is designed and directed through the system, using fabricated manifold 12, cancels out typical problems of "blower pulsation" due to unequal fuel distribution. Once fabricated manifold 12 is pressurized, which takes a negligible amount of time, all cylinders are supplied equally and consistently. A stock supercharger/blower may be used for the system 10 and does not have to be modified, thereby leaving room for carburetor 20, and an air filter 28 at the "firewall" bulkhead of the car engine compartment.

Fabricated intake manifold 12 is preferably fabricated from ¼" hardened aluminum which is preferred for its expansion and contraction rate characteristics, and has openings to connect to supercharger 16, bypass valve 18 and stock intake manifold 14. The fabricated intake manifold may be adjusted in dimension to fit the particular type of engine being supercharged. The entire system 10 is connectable with nuts, bolts, and rubber or rubber-like washers formed of a material that is not affected, destroyed or degraded by oil or gas, to ensure secure connection, and to prevent air leakage during boost. An adapter plate 12*a* having a tapered opening is attached between supercharger 16 and fabricated manifold 12 to direct the air-fuel mixture from the larger pressure outlet opening of supercharger 16 to the smaller inlet opening of fabricated manifold 12 and prevent leakage.

There is a rigid support 34, formed preferably of steel for its desired strength and rigidity, disposed between the lower part of the supercharger case and the engine motor mount for additional physical support of the system 10, as shown in FIG. 1. However the positioning and/or even the need for such a support may depend on the particular type of engine and vehicle in which the supercharger system is being installed.

Figure 4:
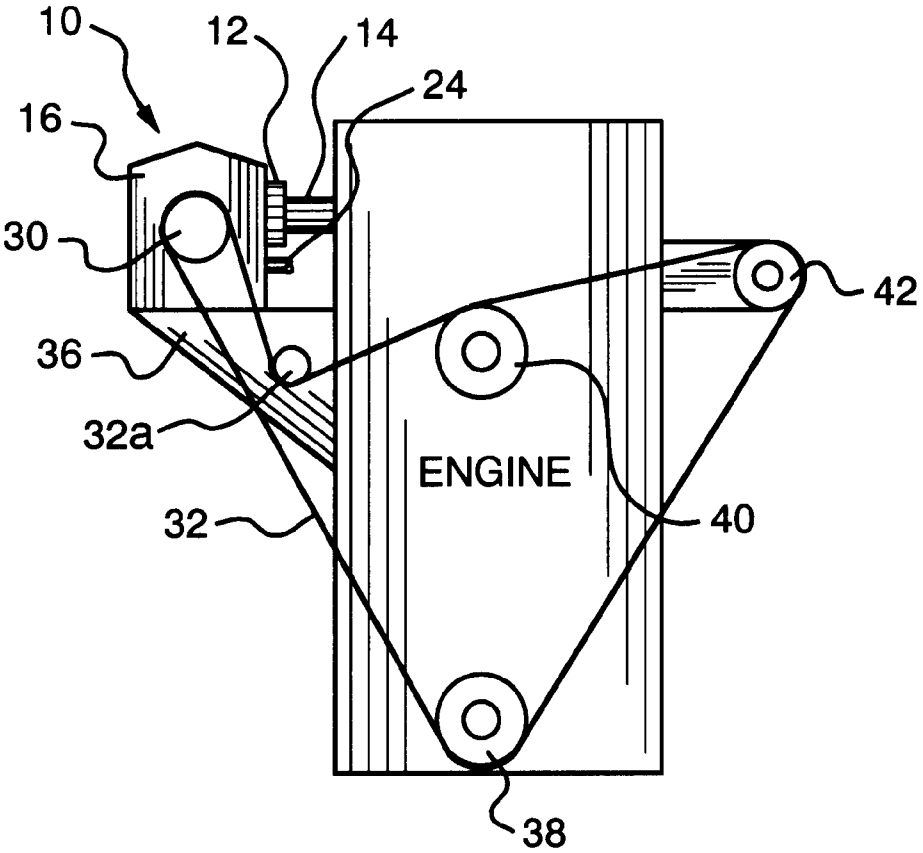
FIG. 4 is a schematic front view of the system of the present invention.

A generic small block idler pulley, as shown in FIGS. 1 and 4, preferably about 3" in diameter, is attached to a pulley support bracket 36, shown in FIG. 4, that runs or extends from under the "snout" or front portion of supercharger 16 to the engine's front "lifting bracket" (not shown), and is used to power supercharger 16 and labeled as supercharger pulley 30. (The "lifting bracket" is an approximately ⅛" sheet of metal that has a hole for attachment of a device or hook to remove the engine from the vehicle if need be.) Pulley support bracket 36 is a solid, roughly triangular piece of material, preferably aluminum. The location and positioning of the various supports may be varied to suit the particular engine and vehicle in which the supercharger system is installed. The dimensions of supercharger pulley 30 are related to the dimensions of the crankshaft pulley 38. The size of crankshaft pulley 38 determines the overall engine speed and the size of supercharger pulley 30 must be determined in relation to crankshaft pulley 38 such that the supercharger is not driven at too fast or too slow a speed. Supercharger 16 has a maximum speed of approximately 15,000 RPM, and if the speed is too great too much pressure is created, thereby stressing the engine potentially to the point of failure. If speed is too slow, supercharger 16 would not provide enough boost to add power to the engine. Thus the size of supercharger pulley affects the ability of supercharger 16 to perform as required. Therefore the dimensions of supercharger pulley 30 were initially determined in relation to the dimensions of crankshaft pulley 38 which determines the speed at which all the engine pulleys turn.

Pulley 30 is preferably driven by a 65" V-belt 32 or similar type belt device as shown schematically in FIG. 4, and is tensioned by a belt tensioner 32*a* which is attached to pulley support bracket 36. FIG. 4 also shows the additional items driven by belt 32, including water pump pulley 40, alternator pulley 42, and crankshaft pulley 38. Belt 32 is longer than the stock engine drive belt because it must now drive an additional pulley at an additional location.

To connect the system 10, one choke cable 44 may be used with the one carburetor of the present system. Choke cable 44 is attached to carburetor 20 and to throttle shaft 45 such that when the engine is idling and not under boost the fuel-air mixture is directed through bypass valve 18 directly into fabricated intake manifold 12, and when the engine is under boost conditions the fuel-air mixture is directed through bypass valve 18 into supercharger 16. If the engine on which this system is being installed had dual carburetors, one choke cable is used in the system and the second choke cable may be cut off, or simply rolled up and fastened where it will not be damaged, in case the system is removed and the original dual carburetor assembly re-installed. The system is also adaptable to engines having mechanical, as opposed to cable, throttle linkages wherein the mechanical throttle linkage would also be attachable to bypass valve 18. The exact connection of the throttle linkage to the supercharger system will vary depending on the particular engine used with the supercharger system.

The brake vacuum servo hose may be left connected as it was in the OEM system of the vehicle and will ensure adequate stopping power even when the vehicle is under boost. This connection is needed because all of the ports of the stock intake manifold 14 will have positive pressure during boost conditions.

A hose 46 may be connected to fabricated intake manifold 12 to attach a vacuum-boost gauge to provide the ability to monitor the boost pressure.

The EGR (Exhaust Gas Recirculation) port, if the vehicle has one for emission control, may be left intact. All OEM emission control devices may be left intact for the installation and operation of the present system.

System 10 can run smoothly at about 1500 RPM, there is no hesitation in boost when the accelerator is depressed, and the boost is consistent throughout the RPM range. The timing (for Triumph TR6 engines for example) may be set preferably at 8 degrees BTDC (Before Top Dead Center). The timing of the engine may have to be adjusted upon installation of the supercharging system of the present invention. The system provides about 8 pounds of boost at full throttle and may run on unleaded gasoline of normal octane levels (about 87–93 octane) without any significant pre-detonation and little or no "blower whine". The system 10, for example in a Triumph TR6, may optimally run at 7.5 to 1 compression, when not under boost, for maximum blower/supercharger efficiency. When under boost, the system raises the compression ratio to 9 to 1 or greater. The higher an unboosted compression ratio, the higher the boosted compression ratio will be. Compression that is too high will eventually produce too much pressure for the engine and engine components will fail. Thus the system functions best with engines having an unboosted compression ratio of 7.5 to 1 or less.

The system may also include at least one preferably 2" flexible hose to direct cool air directly to air filter 28 of carburetor 20 to minimize air inlet temperature and offset the inevitable temperature increase from supercharger 16. Cooling the intake air helps prevent temperature-induced pre-detonation, especially as the ambient temperature rises in warm weather. The system could also be fitted with an intercooler through which the fuel-air mixture is passed before it enters supercharger 16. The system may also be adapted to cool a fuel injected engine.

The system burns fuel efficiently and produces excellent emissions test results. The system is also relatively inexpensive and easy to install.

The invention also includes a method for supercharging an engine, comprising the steps of removably attaching fabricated intake manifold 12 to the stock intake manifold 14 of an engine in flow communication with the stock intake manifold 14; removably attaching supercharger (blower) 16 to fabricated intake manifold 12 using adapter plate 12*a*, in flow communication with fabricated intake manifold 12; attaching bypass valve 18 in straight line flow communication between carburetor 20 and supercharger 16, using bypass adapter ring 22, wherein bypass valve 18 allows the air-fuel mixture from carburetor 20 to bypass supercharger 16 and flow directly into fabricated manifold 12 and then into the stock intake manifold 14 of the engine when there is no boosting power to the engine. When under boost there is a straight line flow of the air-fuel mixture from carburetor 20 or fuel injection system through bypass valve 18 and into supercharger 16. The method also includes injecting cooling fluid such as water into the air-fuel mixture to prevent pre-detonation of the air-fuel mixture when the engine is under boost conditions. Injecting water into the air-fuel mixture is accomplished by adapter ring 22 which has at least one inlet port 48 through which water (or other cooling fluid) may be injected to mix with the air-fuel mixture entering bypass valve 18.

The method also includes relieving the system of excess pressure by installing sneeze valve 24 at the side of fabricated intake manifold 12 facing the engine, and setting sneeze valve 24 to release if the air pressure in the system becomes excessive. The method operates by driving supercharger 16 with supercharger pulley 30 driven by belt 32.

Adequate stopping power, even under boost, is provided by leaving the brake vacuum servo connected in its original OEM format. Also, all OEM emissions control devices are left intact.

The invention may also include a readily installable kit containing the fabricated air intake manifold, the adapter plate for attaching a supercharger to the fabricated air intake manifold, an adapter ring for attaching a bypass valve assembly to the fabricated air intake manifold, a supercharger pulley and drive belt, all of the necessary, nuts, bolts, washers and other fittings necessary to install the supercharger system in vehicle, and installation instructions. The items not included with the kit would be the supercharger, a carburetor and air filter, and the bypass valve assembly which would be purchased from the manufacturer.

While the invention has been described with reference to a preferred embodiment, the foregoing description is illustrative only, and does not limit the scope of the invention. Those of ordinary skill in the art will see that there are possible variations in the structure and function of the system that do not depart from the spirit and scope of the invention and are thus encompassed by the foregoing description.

Accordingly, what is claimed is:

1. A "bolt-on" supercharger system, that is attachable directly to an in-line engine without significant modification of the engine, comprising:

a fabricated intake manifold removably attachable to the stock intake manifold of an engine and in flow communication with the stock intake manifold;

a supercharger removably attachable to said fabricated intake manifold and in flow communication with said fabricated manifold;

a bypass valve assembly attachable and in straight line flow communication between a carburetor or fuel injection system and said supercharger and in flow communication with said fabricated intake manifold, wherein said bypass valve assembly is joined to said carburetor or fuel injection system by a bypass ring adapter, wherein said bypass valve assembly allows an air-fuel mixture from said carburetor or fuel injection system to bypass said supercharger and flow directly into said fabricated intake manifold when said system is not in a power boost mode.

2. The supercharger system of claim 1 wherein said fabricated intake manifold is formed of aluminum.

3. The supercharger system of claim 1 wherein said bypass ring adapter includes at least one inlet port for injection of a cooling fluid to prevent pre-detonation at increased engine speed and boost.

4. The supercharger system of claim 1 wherein a pressure outlet side of said supercharger is located almost directly in line with the air intake port of the front three cylinders of an in-line six cylinder engine.

5. The supercharger system of claim 1 wherein a pressure outlet side of said supercharger is located almost directly in line with the air intake port of the front two cylinders of an in-line four cylinder engine.

6. The supercharger system of claim 1 wherein the supercharger system is attachable with nuts, and bolts with rubber-like washers, to prevent air leakage during boost.

7. The supercharger system of claim 6 wherein said rubber-like washers are formed of a material resistant to degradation by oil and gasoline.

8. The supercharger system of claim 1 wherein there is a sneeze valve placed on a side of said fabricated intake manifold facing the engine, and said sneeze valve is set to release if the air pressure in the system increases abruptly, thereby preventing a broken supercharger blade, or a hole in the top of a piston due to excess pressure.

9. The supercharger system of claim 1 wherein there is a rigid support between a lower part of a case of said supercharger, and a standard engine motor mount for support of said supercharger.

10. The supercharger system of claim 1 wherein said supercharger is driven by a supercharger pulley, and is supported by a pulley support bracket that runs from under a front portion of said supercharger to a front lifting bracket of the car engine for additional support of said supercharger and to which is mounted a belt tensioner which aids in driving said supercharger pulley.

11. The supercharger system of claim 10 wherein said supercharger pulley is sized proportionately to a crankshaft pulley which drives the engine, such that the speed at which said supercharger is driven is proportional to the engine speed.

12. The supercharger system of claim 10 wherein said supercharger pulley has a diameter of about 3 inches.

13. The supercharger system of claim 10 wherein a V-belt of about 65 inches in length is used to drive said supercharger pulley.

14. The supercharger system of claim 1 wherein a vacuum boost gauge is attachable to a hose which is connectable to said fabricated intake manifold to monitor the supercharging pressure.

15. The supercharger system of claim 1 wherein at least one flexible hose is connectable to an air filter attached to said carburetor to direct cool air into said air filter and said carburetor.

16. The supercharger system of claim 1 wherein said system is connectable to a fuel injected engine at said bypass valve assembly.

17. A method of supercharging engines comprising the steps of:

removably attaching a fabricated intake manifold to the stock intake manifold of an engine in flow communication with the stock intake manifold;

removably attaching a supercharger to said fabricated intake manifold, in flow communication with said fabricated intake manifold;

removably attaching a bypass valve assembly in straight line flow communication between a carburetor or fuel injection system and said supercharger, and in flow communication with said fabricated intake manifold, wherein said bypass valve is joined to said carburetor or fuel injection system by a bypass ring adapter;

directing, with said bypass valve, an air-fuel mixture from said carburetor or fuel injection system to bypass said supercharger and flow directly into said fabricated intake manifold when boosting is not occurring.

18. The method of claim 17 further comprising forming said fabricated intake manifold from aluminum.

19. The method of claim 17 further comprising providing at least one inlet port in said bypass adapter ring for injection of cooling fluid into the air-fuel mixture to prevent pre-detonation, at increased RPM and boost.

20. The method of claim 17 further comprising locating a pressure outlet side of said supercharger almost directly in line with the air intake port of the front three cylinders of an in-line six cylinder engine.

21. The method of claim 17 further comprising locating a pressure outlet side of said supercharger almost directly in line with the air intake port of the front two cylinders of an in-line four cylinder engine.

22. The method of claim 17 further comprising attaching said fabricated intake manifold, said supercharger, said bypass adapter ring, and said bypass valve assembly with nuts, bolts and rubber-like washers, to prevent air leakage during boost.

23. The method of claim 17 further comprising placing a sneeze valve on a side of said fabricated aluminum intake manifold facing the engine, and setting said sneeze valve to release if the air pressure in the system increases abruptly, thereby preventing a broken supercharger blade, or a hole in the top of a piston due to excess pressure.

24. The method of claim 17 further comprising placing a rigid support between a lower part of a case of said supercharger, and a standard engine motor mount for support of said supercharger; and placing a support bracket under a front portion of said supercharger and attaching a tensioner to said support bracket.

25. The method of claim 17 further comprising the step of driving said supercharger by a supercharger pulley, using a V-belt of about 65 inches in length to drive said supercharger pulley.

26. The method of claim 17 further comprising attaching a hose to said fabricated intake manifold and to a vacuum boost gauge and monitoring the supercharging pressure.

27. A kit for supercharging in-line internal combustion engines, said kit comprising:

a fabricated intake manifold which is removably attachable to, and in flow communication with, the stock intake manifold of an engine;

an adapter plate to connect a supercharger to said fabricated intake manifold;

a bypass adapter ring, attachable to a bypass valve assembly which is attachable in straight line flow communication between a carburetor or fuel injected system and the supercharger and in flow communication with said fabricated intake manifold;

a supercharger pulley and drive belt;

a rigid support to support said supercharger;

a pulley support bracket and tensioner used with said supercharger pulley and drive belt;

a plurality of nuts, bolts, rubber-like washers, and other necessary attachment means to install said kit in an engine; and installation instructions.

* * * * *